US008365825B1

(12) United States Patent
Yarbro

(10) Patent No.: US 8,365,825 B1
(45) Date of Patent: Feb. 5, 2013

(54) SUPPRESSING VOLTAGE TRANSIENTS IN PERFORATION OPERATIONS

(75) Inventor: Gregory Scott Yarbro, Casper, WY (US)

(73) Assignee: Halliburton Energy Services, Inc., Houston, TX (US)

( * ) Notice: Subject to any disclaimer, the term of this patent is extended or adjusted under 35 U.S.C. 154(b) by 539 days.

(21) Appl. No.: 12/613,684

(22) Filed: Nov. 6, 2009

(51) Int. Cl.
*E21B 43/116* (2006.01)
*E21B 43/1185* (2006.01)

(52) U.S. Cl. ..... 166/297; 166/65.1; 102/312; 361/248

(58) Field of Classification Search ..... 166/297, 166/65.1; 102/312, 313; 361/248
See application file for complete search history.

(56) References Cited

U.S. PATENT DOCUMENTS 4,457,383 A * 7/1984 Boop ..... 175/4.55
4,527,636 A * 7/1985 Bordon ..... 175/4.55
4,637,463 A * 1/1987 McCoy ..... 166/250.01
4,875,413 A 10/1989 Christopher et al.
4,991,684 A * 2/1991 Mitchell ..... 181/106
5,207,273 A * 5/1993 Cates et al. ..... 166/369
5,503,077 A 4/1996 Motley
5,531,164 A * 7/1996 Mosley ..... 102/312
6,470,803 B1 * 10/2002 Liu et al. ..... 102/206
6,543,538 B2 4/2003 Tolman et al.
7,436,184 B2 * 10/2008 Moore ..... 324/347
2004/0108114 A1 * 6/2004 Lerche et al. ..... 166/302
2005/0279503 A1 * 12/2005 Wilson et al. ..... 166/297
2007/0158071 A1 7/2007 Mooney, Jr. et al.
2008/0149338 A1 6/2008 Goodman et al.
2011/0290011 A1 * 12/2011 Dowla et al. ..... 73/152.16

OTHER PUBLICATIONS

Dynawell, "The Dynaenergetics—Dynawell RF-Safe Electronic Detonating System".

* cited by examiner

*Primary Examiner* — Daniel P Stephenson
(74) *Attorney, Agent, or Firm* — Howard L. Speight

(57) ABSTRACT

A perforating system includes a casing collar locator. The casing collar locator includes a coil. The perforating system includes a plurality of perforation charge elements. Each perforation charge element is in a circuit parallel to the coil. The perforating system includes a transient voltage suppressor in a circuit parallel to the coil.

14 Claims, 5 Drawing Sheets

SUPPRESSING VOLTAGE TRANSIENTS IN PERFORATION OPERATIONS

BACKGROUND

An oil well typically goes through a "completion" process after it is drilled. Casing is installed in the well bore and cement is poured around the casing. This process stabilizes the well bore and keeps it from collapsing. Part of the completion process involves perforating the casing and cement so that fluids in the formations can flow through the cement and casing and be brought to the surface. The perforation process is often accomplished with shaped explosive charges. These perforation charges are often fired by applying a voltage to the charges.

DETAILED DESCRIPTION

Figure 1:
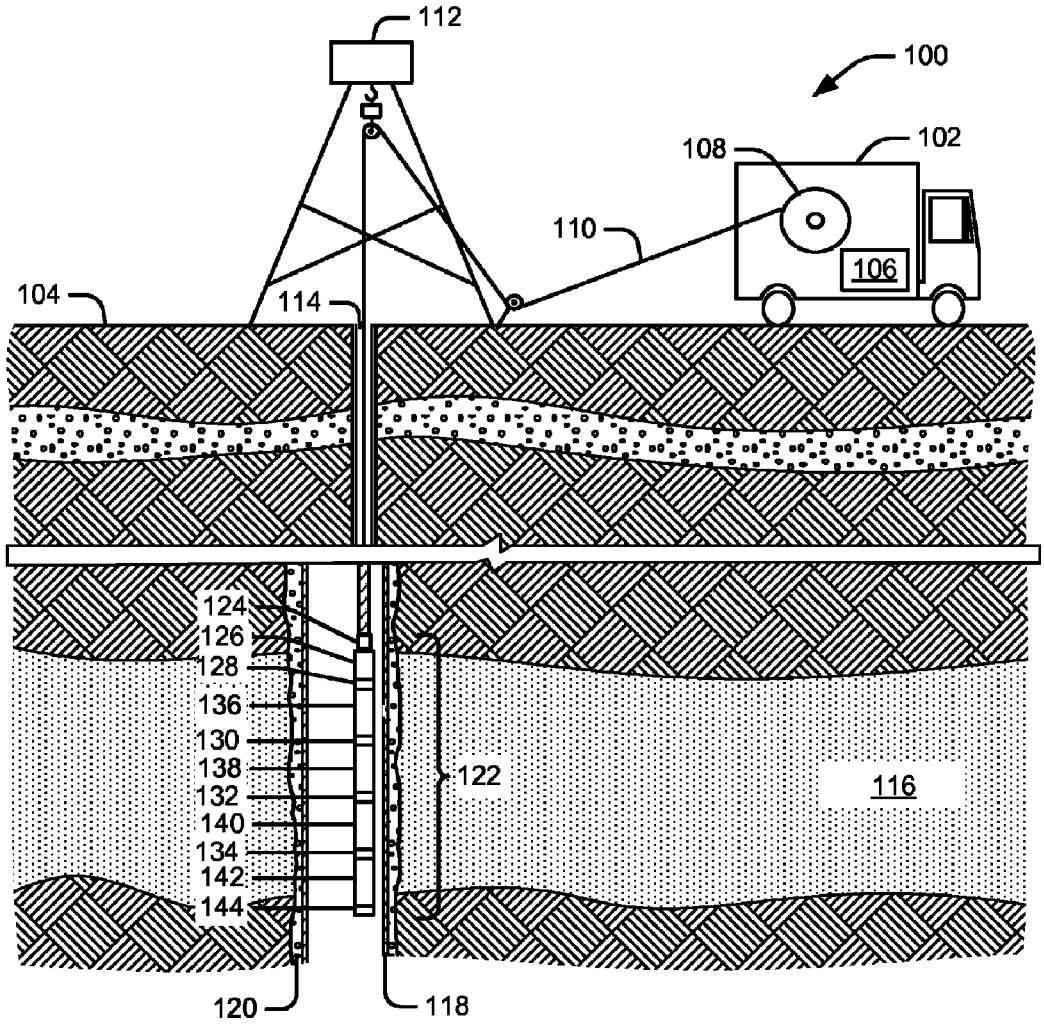
FIG. 1 illustrates a perforation system.

In one embodiment of a perforation system 100 at a drilling site, as depicted in FIG. 1, a logging truck or skid 102 on the earth's surface 104 houses a shooting panel 106 and a winch 108 from which a cable 110 extends through a derrick 112 into a well bore 114 drilled into a hydrocarbon-producing formation 116. In one embodiment, the derrick 112 is replaced by a truck with a crane (not shown). The well bore is lined with casing 118 and cement 120. The cable 110 suspends a perforation apparatus 122 within the well bore 114.

Figure 3:
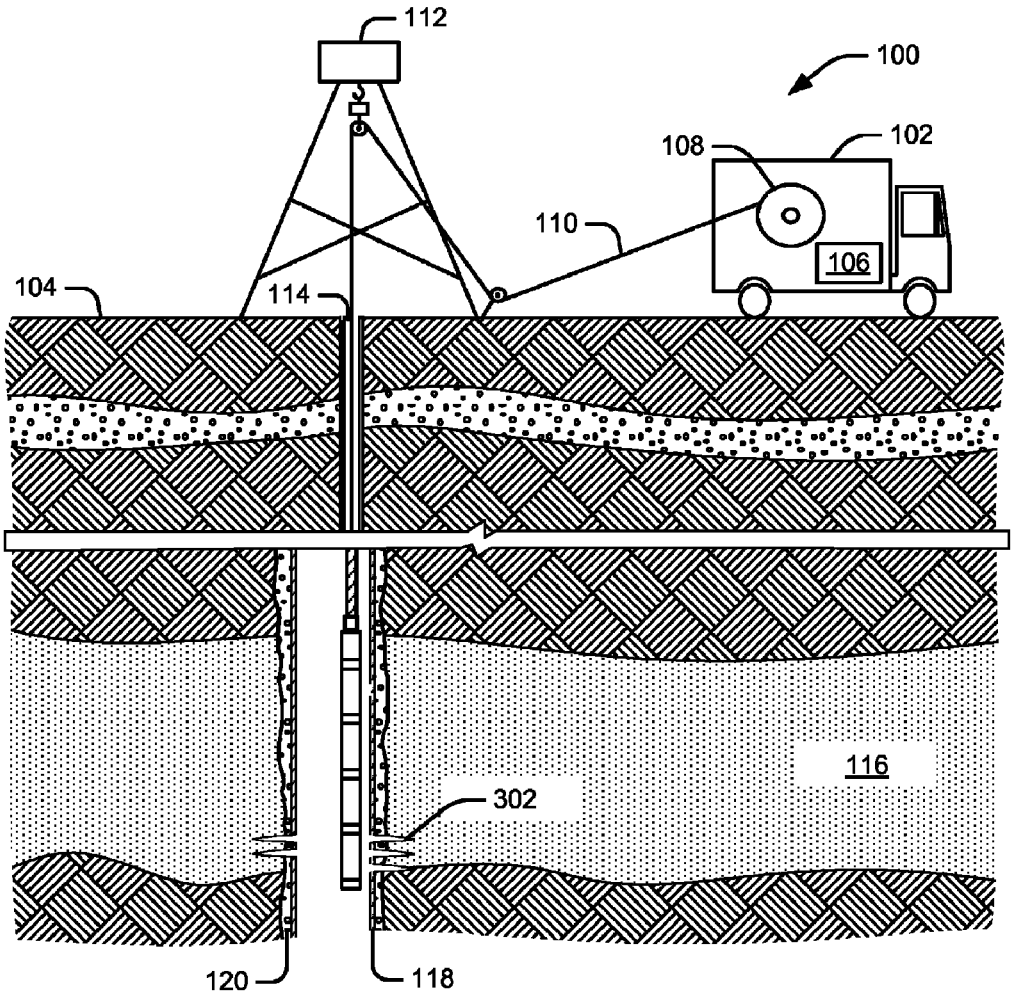
FIG. 3 illustrates the perforation system after one of the perforation charges has been fired.

In one embodiment shown in FIGS. 1 and 3, the perforation apparatus 122 includes a cable head/rope socket 124 to which the cable 110 is coupled. In one embodiment, an apparatus to facilitate fishing the perforation apparatus (not shown) is included above the cable head/rope socket 124. In one embodiment, the perforation apparatus 122 includes a casing collar locator ("CCL") 126, which facilitates the use of magnetic fields to locate the thicker metal in the casing collars (not shown). The information collected by the CCL can be used to locate the perforation apparatus 122 in the well bore 114.

In one embodiment, the perforation apparatus 122 includes a top fire sub ("TFS") 128 that provides an electrical and control interface between the shooting panel 106 on the surface and the rest of the equipment in the perforation apparatus 122.

In one embodiment, the perforation apparatus 122 includes a plurality of select fire subs ("SFS") 130, 132, 134 and a plurality of perforation charge elements (or perforating gun or "PG") 136, 138, 140, and 142. In one embodiment, the number of select fire subs is one less than the number of perforation charge elements.

Figure 4:
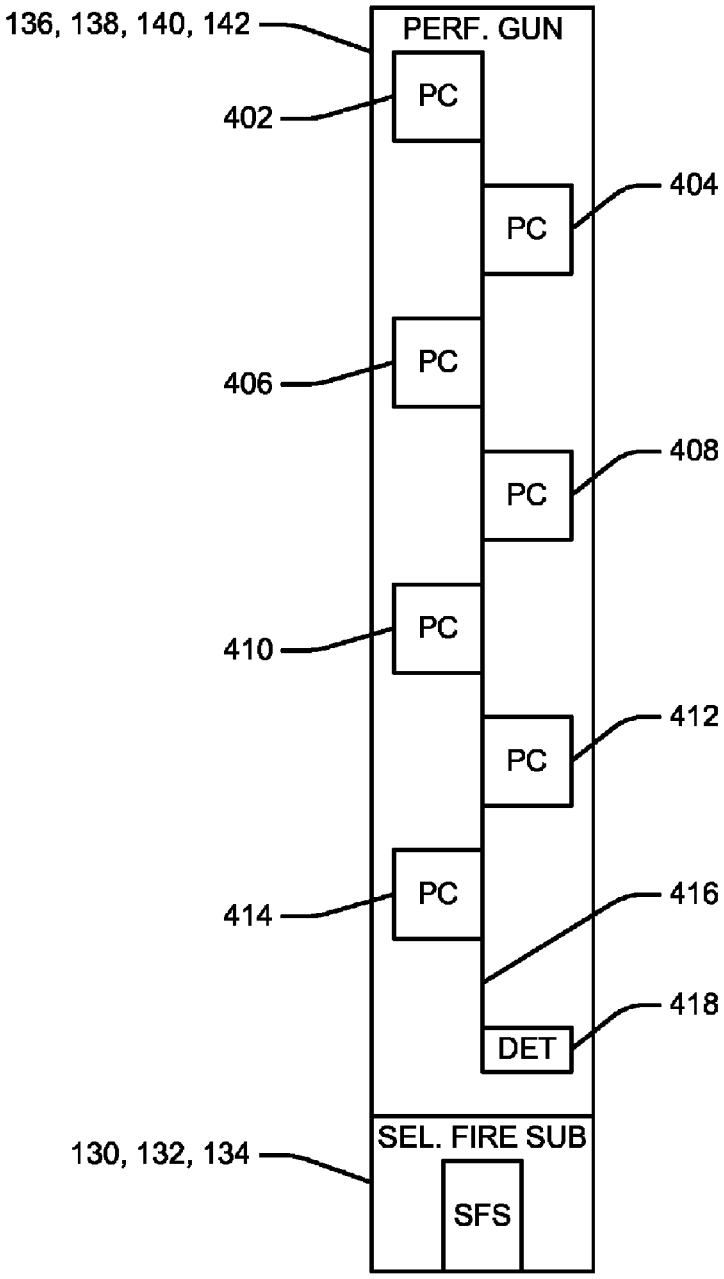
FIG. 4 is a mechanical block diagram of a perforation apparatus.
Figure 5:
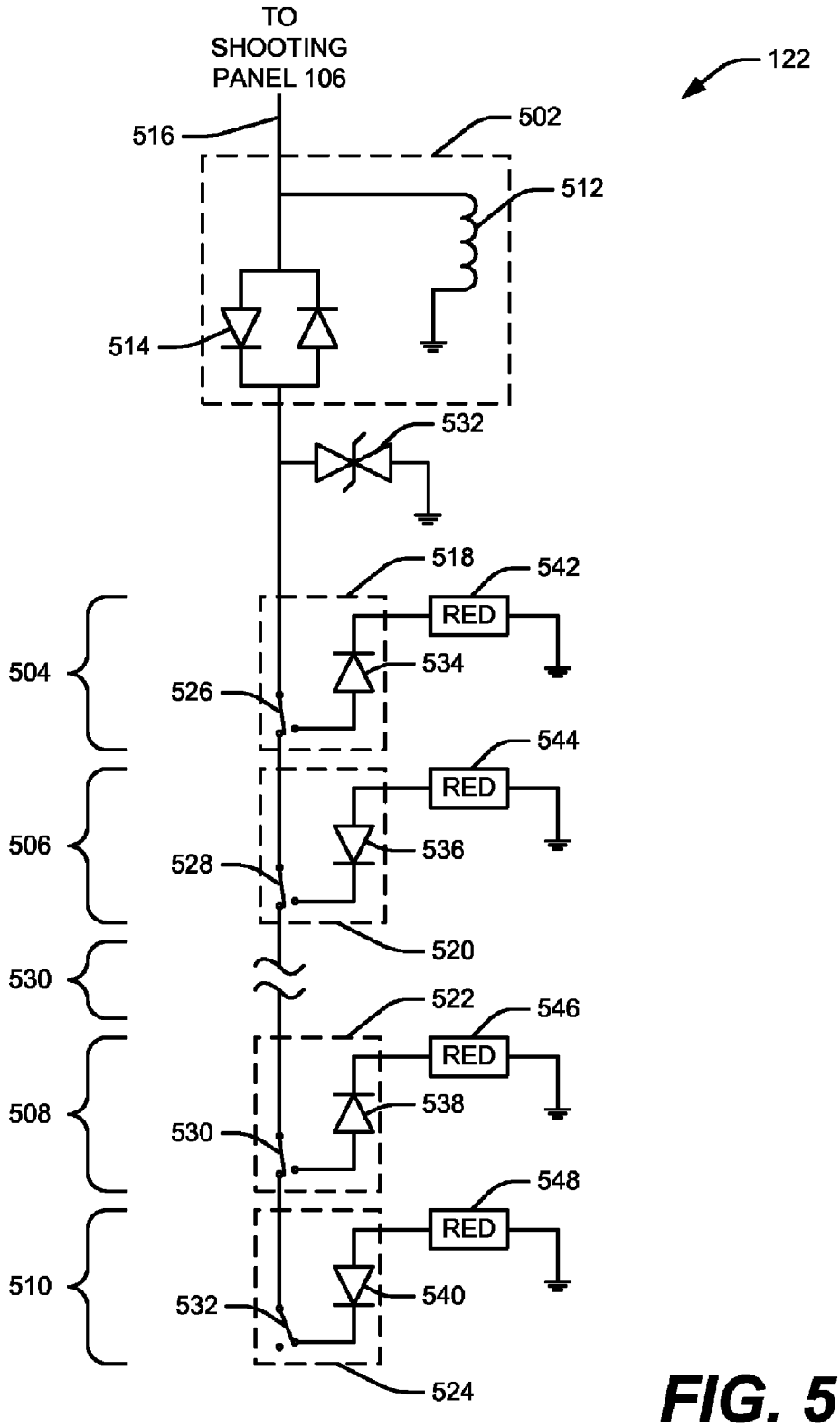
FIG. 5 is an electrical block diagram of a perforation apparatus.

The CCL 126 and the perforation charge elements 136, 138, and 140 are described in more detail in the discussion of FIGS. 4 and 5. It will be understood by persons of ordinary skill in the art that the number of select fire subs and perforation charge elements shown in FIG. 1 is merely illustrative and is not a limitation. Any number of select fire subs and sets of perforation charge elements can be included in the perforation apparatus 122.

In one embodiment, the perforation apparatus 122 includes a bull plug 142 that facilitates the downward motion of the perforation apparatus 122 in the well bore 114. In one embodiment, the perforation apparatus 122 includes magnetic decentralizers (not shown) that are magnetically drawn to the casing causing the perforation apparatus to draw close to the casing as shown in FIG. 1.

FIG. 3 shows the result of the explosion of the lowest perforation charge element. Passages 302 (only one is labeled) have been created from the formation 116 through the concrete 120 and the casing 118. As a result, fluids can flow out of the formation 116 to the surface 104.

One embodiment of a perforation charge element 136, 138, 140, 142, illustrated in FIG. 4, includes 6 perforating charges 402, 404, 406, 408, 410, 412, and 414. It will be understood that by a person of ordinary skill in the art that each perforation charge element 136, 138, 140, 142 can include any number of perforating charges.

Figure 2:
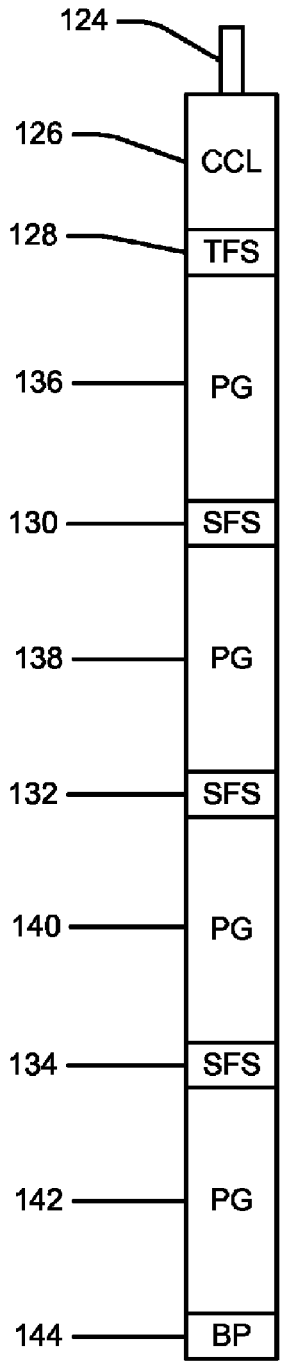
FIG. 2 illustrates a perforation apparatus.

In one embodiment, the perforating charges are linked together by a detonating cord 416 which is attached to a detonator 418. In one embodiment, when the detonator 418 is detonated, the detonating cord 416 links the explosive event to all the perforating charges 402, 404, 406, 408, 410, 412, 414, detonating them simultaneously. In one embodiment, a select fire sub 130, 132, 134 containing a single select fire switch 420 is attached to the lower portion of the perforating charge element 136, 138, 140, 142. In one embodiment, the select fire sub 130, 132, 134 defines the polarity of the voltage required to detonate the detonator in the perforating charge element above the select fire sub. Thus in one embodiment, referring to FIG. 2, select fire sub 130 defines the polarity of perforating charge element 136, select fire sub 132 defines the polarity of perforating charge element 138, and select fire sub 134 defines the polarity of perforating charge element 140. In one embodiment, the bottom-most perforating charge element 142 is not coupled to a select fire sub and thus can be detonated by a voltage of either polarity.

One embodiment of the electrical connections within a perforation apparatus 122, illustrated in FIG. 5, includes a CCL 502 and perforation charge elements 504, 506, 508, and 510. The CCL 502 includes a coil 512 and a dual diode circuit 514. The coil 512 generates the magnetic field that is used to detect the casing couplings. The dual diode circuit 514, which prevents the coil 512 from shorting out through low voltage detonators, is not present in all embodiments, in particular when RF-safe detonators are used, as described below.

In one embodiment, the perforation apparatus 122 is electrically coupled to the shooting panel 106 by a wire or wires 516 that is included in cable 510.

In one embodiment, each perforation charge element 504, 506, 508, 510 includes a positive/negative pressure actuated select fire switch 518, 520, 522, 524 (hereinafter "select fire switch"). In one embodiment, each select fire switch 518, 520, 522, 524 includes a pressure activated switch 526, 528, 530, 532 and a steering diode 534, 536, 538, 540. In one embodiment, each pressure activated switch 526, 528, 530, 532 has a connect position, in which voltages applied to the pressure activated switch is applied to the respective steering diode 534, 536, 538, 540 (pressure activated switch 532 is in the connect position in FIG. 5), and a pass-through position, in which such applied voltage bypass the steering diodes (pressure activated switches 526, 528, and 530 are in their pass-through positions in FIG. 5). In one embodiment, the steering diodes 534, 536, 538, 540 are separate and not incorporated into the select fire switch.

In one embodiment, each perforation charge element 504, 506, 508, 510 includes a detonator 542, 544, 546, 548 coupled to a respective select fire switch 518, 520, 522, 524 through its respective steering diode 534, 536, 538, 540 (note that the detonating cord and perforating charges are not shown in FIG. 5). In one embodiment, the detonators 542, 544, 546, 548 are RF-safe detonators, meaning that they are not susceptible to accidental radio frequency ("RF")-induced firing in a typical rig RF environment. In one embodiment, the detonators 542, 544, 546, 548 are Rig Environment Detonator (RED) devices manufactured by Jet Research Center, which is a subsidiary of the assignee of the present application.

In one embodiment, each perforating charge element includes at least one and preferably a plurality of perforating charges. The number of perforating charges is, in one embodiment, referred to as the number of charges per foot of gun. Common load density is 6 shots (perforation charges) per foot (of gun). In such an embodiment, if each of the perforating charge elements is 5 feet long, each gun would contain 30 charges. In one embodiment, all of the charges in a perforating charge element are detonated simultaneously. In one embodiment, the perforating charge element in a perforation apparatus may have a variety of lengths (i.e., from the bottom up, 5 foot gun, 3 foot gun, 2 foot gun, 7 foot gun) and shot densities (i.e., 1 shot/foot, 2 shots/foot, 3 shots/foot, 4 shots/foot, and 6 shots/foot).

In one embodiment, such as that illustrated in FIG. 1, the bottom-most perforation charge element 510 does not include a select fire switch 524 and the detonator 548 is wired directly to the wire 516. In one embodiment, the steering diode 540 is included in the circuit between the wire 516 and the detonator 548 to allow for human error.

In one embodiment, a detonator 542, 544, 546, 548 fires when a voltage is applied to it. In one embodiment, the voltage at which a detonator will fire is defined by a bell-shaped curve. Above an "all fire" voltage, virtually all of the detonators will fire and below a "no fire" voltage, virtually none of the detonators will fire. In one embodiment, the no fire voltage for detonators 542, 544, 546, 548 is 150 volts. In one embodiment, the all fire voltage for detonators 542, 544, 546, 548 is 180 volts.

In one embodiment, the shooting panel 106 has three positions: (1) a first position in which no voltage is applied to wire 516, (2) a second position in which a positive voltage relative to ground is applied to wire 516, and (5) a third position in which a negative voltage relative to ground is applied to wire 516.

In one embodiment, the select fire switches are polarized in the sense that the steering diodes in each select fire switch allows only one polarity of applied voltage to penetrate to the perforation charge. For example, in one embodiment, a positive voltage applied to select fire switch 524 will be blocked by steering diode 540 and will not reach the detonator 548 with sufficient voltage to cause it to fire. In one embodiment, a negative voltage applied to select fire switch 524 will pass through the steering diode 540 and reach the detonator 548 and cause it to fire (assuming the voltage is large enough). Thus, in one embodiment, select fire switch 524 is said to have a negative polarity.

In one embodiment, select fire switch 522 is said to have a positive polarity. In one embodiment, a positive voltage applied to select fire switch 522 with the pressure activated switch 530 in the connect position (i.e., the position not shown in FIG. 5) will pass through the steering diode 538 and be applied to the detonator 546. In one embodiment, negative voltage applied to select fire switch 522 will be blocked by the steering diode 538 and will not reach the detonator 546.

In one embodiment, select fire switch 520 has a negative polarity. In one embodiment, select fire switch 518 has a positive polarity.

In one embodiment, pressure activated switches 526, 528, and 530 are originally set in their pass-through positions and pressure activated switch 532 is set in its connect position (or is replaced by a wire as discussed above), as shown in FIG. 5. In that state, in one embodiment, an application of a negative voltage by the shooting panel 106 to wire 516 will pass through the dual diode 514, all of the pressure activated switches 526, 528, 530, 532 and diode 540 and be applied to detonator 548. Assuming the voltage is sufficient, the detonator 548 will fire and its associated perforating charges (not shown in FIG. 5) will detonate and perforate the casing and concrete as shown in FIG. 3. In one embodiment, a pressure wave created by the firing of the perforation charges associated with detonator 548 will propagate to pressure activated switch 530, causing it to switch from its pass-through state to its connected state. In one embodiment, the voltage applied by the shooting panel will be blocked by the steering diode 548 and thus will not fire the detonator 546.

In that state, in one embodiment, an application of a positive voltage by the shooting panel 106 to wire 516 will pass through the dual diode 514, pressure activated switches 526, 528, 530 and diode 538 and be applied to detonator 546. Assuming the voltage is sufficient, in one embodiment, the perforation charge 546 will fire and its associated perforating charges (not shown in FIG. 5) will detonate and perforate the casing and concrete as shown in FIG. 3. In one embodiment, the pressure wave created by the firing of the perforation charges associated with detonator 546 will propagate to a pressure activated switch that is not shown but is indicated by the connectors 530 (which, in one embodiment, represents a plurality of perforation charge elements), causing it to switch from its pass-through state to its connected state, allowing the firing of the plurality of perforation charges that are not shown in FIG. 5.

In that way, in one embodiment, by alternating the application of positive and negative voltages by the shooting panel to wire 516, the perforation charges indicated by connectors 530 will be fired, eventually causing a pressure wave to switch pressure activated switch 528 from its pass-through state to its connected state.

In that state, in one embodiment, an application of a negative voltage by the shooting panel 106 to wire 516 will pass through the dual diode 514, pressure activated switches 526 and 528 and diode 536 and be applied to detonator 544. Assuming the voltage is sufficient, the perforation charge 544 will fire and its associated perforating charges (not shown in FIG. 5) will detonate and perforate the casing and concrete as shown in FIG. 3. In one embodiment, a pressure wave created by the firing of the perforation charges associated with detonator 544 will propagate to pressure activated switch 526, causing it to switch from its pass-through state to its connected state. In one embodiment, the voltage applied by the shooting panel will be blocked by the steering diode 534 and thus will not fire detonator 542.

In that state, in one embodiment, an application of a positive voltage by the shooting panel 106 to wire 516 will pass through the dual diode 514, pressure activated switch 526 and diode 534 and be applied to perforation detonator 542. Assuming the voltage is sufficient, in one embodiment, the perforation charge 542 will fire and its associated perforating charges (not shown in FIG. 5) will detonate and perforate the casing and concrete as shown in FIG. 3.

As can be seen in FIG. 5, the CCL includes a coil 512. A coil is an inductive device. When an inductive device, such as coil 512, is subjected to a sudden change in current, such as happens when a device is suddenly turned on or off, a voltage spike, known as a counter electro-motive force ("CEMF" or "counter EMF") transient or fly-back voltage is induced in attached parallel circuits.

The voltage across an inductor, such as coil 512, when the current through the inductor is changing with time is defined by the following equation:

$$v(t) = L\frac{d}{dt}i(t)$$

where:

v(t) is the voltage across the inductor;

L is the inductance of the inductor, in henrys; and i(t) is the time-varying current through the inductor.

At least two conditions can occur in the circuit shown in FIG. 5 that can create significant counter EMF spikes. An intermittent connection above the CCL, such as an intermittent connection in the cable head 124, weight bars (not shown), or other devices between the cable 110 and the CCL can result in a rapidly changing current through the CCL coil 512 and thus a high counter EMF voltage across the coil 512.

A second condition may occur if the wire running from the CCL to the select fire switches is temporarily shorted to a housing for the perforation charge element during firing. For example, when perforating charge 548 is fired it may temporarily short the wire between pressure activated switch 530 and perforating charge 548 to the perforating charge's housing, which is grounded. This short circuit will rapidly decrease the current flowing through the CCL coil 512 causing counter EMF to be generated across the coil 512.

The magnitude of the counter EMF transients are a function of the current flowing through the coil 512, the inductance of the coil, and the rate of change of the current. The current is a function of the voltage applied to the coil 512 and the coil's resistance. Therefore, the current flowing through the coil is greater for higher firing voltages and coils 512 with lower resistivity.

These counter EMF spikes are created for all perforating firing operations but do not typically represent an operational problem until higher firing voltages and lower CCL coil 512 resistivities are encountered. Higher firing voltages are typically required for RF safe perforating charges. Counter EMF voltage magnitudes with lower CCL coil resistances can be on the order of 20 or 50 times the all fire voltage for a perforation charge. For the voltages used to fire RF safe perforating charges, these counter EMF spikes can exceed 9000 volts. Although of short duration, these extremely high voltage spikes can damage elements of the system, such as a gun isolation system (not shown), and cause damage to the pressure activated switches, potentially resulting in skipped perforating charges and the firing of perforating charges out of zone.

In one embodiment, a transient voltage suppressor 532 is added to the system to suppress the counter EMF transients. The transient voltage suppressor 532 is added to the circuit in parallel with the coil 512 so that any counter EMF transients are clamped to a moderate voltage relative to ground. In one embodiment, the transient voltage suppressor 532 limits counter EMF transients generated in the CCL coil 512 or elsewhere in the system to levels sustainable by other circuits in the system. In one embodiment, the transient voltage suppressor 532 is designed to suppress voltage transients greater than 150 percent of the all fire voltage of the detonators. In one embodiment, the transient voltage suppressor 532 is designed to suppress voltage transients having a rise time less than 8 microseconds and is designed to have a response time of a one picosecond or less. In one embodiment, the transient voltage suppressor is designed to dissipate transients with a peak power of 1500 watts or less. In one embodiment, the transient voltage suppressor 532 is designed to conduct 200 amperes or less of current for a maximum duration of 8 milliseconds.

In one embodiment, the transient voltage suppressor 532 is a oxide varistor (MOV). A MOV conducts only a small amount of current when the voltage across the MOV is less than its "clamping voltage." If the voltage across the MOV exceeds its clamping voltage, the MOV conducts a large amount of current. In the circuit shown in FIG. 5, a large voltage transient across the CCL would appear as a large voltage across the MOV (transient voltage suppressor 532), which would cause the MOV to conduct and dissipate the transient.

In one embodiment, the transient voltage suppressor 532 is a transient suppression diode, such as a Zener diode or an avalanche diode. Such diodes are non-conductive below a threshold voltage but break down and begin conducting above the threshold voltage. Similar to the MOV described above, the transient suppression diode would conduct during large transients, thereby dissipating the transient.

In one embodiment in which the perforation charge elements all have the same polarity as described above, the transient voltage suppressor 532 is a fly-back diode. The fly-back diode is coupled into the circuit (a) so that it does not conduct when the voltage across it has the polarity required to fire the perforation charges, and (b) so that it does conduct when the voltage across it has the opposite polarity, which is the polarity of counter EMF voltage that would be produced by the coil 512. Consequently, the fly-back diode would not conduct during normal operation but would conduct, and thereby suppress, any counter EMF transient.

In one embodiment, the transient voltage suppressor 532 is a resistor/capacitor circuit. The resistor/capacitor circuit would act as a high pass filter. As such, it would not divert the essentially-direct-current voltage applied to fire the perforation charges but would conduct for a high-frequency transient, such as that caused by counter EMF across coil 512.

In one embodiment, there is a single transient voltage suppressor 532 coupled to the wire 516 either above the CCL or below the CCL 502. In one embodiment, the transient voltage suppressor 532 is part of the CCL 502. In one embodiment, at least some of the perforation charge elements 504, 506, 508, 510 include a transient voltage suppressor 532. In one embodiment, a transient voltage suppressor is included in the top-most perforation charge element 504.

The word "coupled" herein means a direct connection or an indirect connection.

The text above describes one or more specific embodiments of a broader invention. The invention also is carried out in a variety of alternate embodiments and thus is not limited to those described here. The foregoing description of the preferred embodiment of the invention has been presented for the purposes of illustration and description. It is not intended to be exhaustive or to limit the invention to the precise form disclosed. Many modifications and variations are possible in light of the above teaching. It is intended that the scope of the invention be limited not by this detailed description, but rather by the claims appended hereto.

The invention claimed is:

1. A perforating system comprising:

a casing collar locator comprising a coil;

a plurality of perforation charge elements, each perforation charge element being in a circuit parallel to the coil; and a transient voltage suppressor in a circuit parallel to the coil, wherein at least some of the perforating charge elements comprise:

a pressure-activated switch;

a steering diode;

a perforation charge;

the pressure-activated switch, steering diode, and perforation charge wired in series into a series circuit; and the pressure-activated switch connecting the series circuit in parallel with the coil upon the application of pressure.

2. The perforating system of claim 1 wherein:

the casing collar locator and the transient voltage suppressor are housed in the same housing.

3. The perforating system of claim 1 wherein:

the transient voltage suppressor is housed separately from the casing collar locator and the plurality of perforation charge elements.

4. The perforating system of claim 1 wherein each perforation charge element comprises an RF-safe perforation charge.

5. A method comprising:

providing a casing collar locator comprising a coil;

providing a perforation charge element in a circuit parallel to the coil; and providing a transient voltage suppressor in a circuit parallel to the coil, wherein providing the perforating charge element comprises:

providing a pressure-activated switch;

providing a steering diode;

providing a perforation charge;

wiring the pressure-activated switch, steering diode, and perforation charge into a series circuit; and coupling the series circuit in parallel with the coil upon the application of pressure to the pressure-activated switch.

6. The method of claim 5 further comprising:

housing the casing collar locator and the transient voltage suppressor in the same housing.

7. The method of claim 5 further comprising:

housing the transient voltage suppressor separately from the casing collar locator and the plurality of perforation charge elements.

8. The method of claim 5 wherein providing the perforation charge element comprises providing an RF-safe perforation charge.

9. A perforating system comprising:

a casing collar locator comprising a coil;

a plurality of perforation charge elements, each perforation charge element being in a circuit parallel to the coil; and a transient voltage suppressor in a circuit parallel to the coil, wherein the transient voltage suppressor comprises a plurality of transient suppression devices, each housed with a separate perforation charge element.

10. The perforating system of claim 9 wherein at least some of the perforating charge elements comprise:

a pressure-activated switch;

a steering diode;

a perforation charge;

the pressure-activated switch, steering diode, and perforation charge wired in series into a series circuit; and the pressure-activated switch connecting the series circuit in parallel with the coil upon the application of pressure.

11. The perforating system of claim 9 wherein each perforation charge element comprises an RF-safe perforation charge.

12. A method comprising:

providing a casing collar locator comprising a coil;

providing a perforation charge element in a circuit parallel to the coil;

providing a transient voltage suppressor in a circuit parallel to the coil, wherein:

providing the transient voltage suppressor comprises providing a plurality of transient suppression devices;

the method further comprises providing a plurality of perforation charge elements; and the method further comprises housing each transient suppression device with a separate perforation charge element.

13. The method of claim 12 wherein providing the perforating charge element comprises:

providing a pressure-activated switch;

providing a steering diode;

providing a perforation charge;

wiring the pressure-activated switch, steering diode, and perforation charge into a series circuit; and coupling the series circuit in parallel with the coil upon the application of pressure to the pressure-activated switch.

14. The method of claim 12 wherein providing the perforation charge element comprises providing an RF-safe perforation charge.

* * * * *